United States Patent [19]

Kuck

[11] Patent Number: 4,968,013

[45] Date of Patent: Nov. 6, 1990

[54] FOOTREST GLIDE ASSEMBLY

[75] Inventor: Jay L. Kuck, Saint Marys, Ohio

[73] Assignee: Midmark Corporation, Versailles, Ohio

[21] Appl. No.: 440,064

[22] Filed: Nov. 22, 1989

[51] Int. Cl.[5] ..... A61G 13/00

[52] U.S. Cl. ..... 269/328

[58] Field of Search ..... 5/60, 90, 66, 67, 68; 269/327, 328, 15; 403/80, 112

[56] References Cited

U.S. PATENT DOCUMENTS

| | | | |
|---|---|---|---|
| 3,334,951 | 8/1967 | Douglass | 269/327 |
| 4,221,371 | 9/1980 | Kuphal | 269/327 |
| 4,284,268 | 8/1981 | Gauthier | 269/328 |
| 4,287,422 | 9/1981 | Kuphal et al. | 269/328 |
| 4,602,756 | 7/1986 | Chatfield | 403/80 |
| 4,796,846 | 1/1989 | Meier et al. | 403/80 |
| 4,821,350 | 4/1989 | Feldt | 269/327 |

*Primary Examiner*—Robert C. Watson

*Attorney, Agent, or Firm*—Biebel, French & Nauman

[57] ABSTRACT

A locking assembly for locking a footrest pad in position relative to a supporting shelf of a medical table footrest assembly. The locking assembly includes a pair of cylindrical glide members attached to the footrest pad for engagement with a pair of slots and holes formed in the supporting shelf. The slots provide a guide for the sliding movement of the pad relative to the shelf, and the holes are located at an end of the slots to provide a locking position for the footrest pad.

10 Claims, 3 Drawing Sheets

10
12
14
16
18
20
22
24
26
28
30
32
34
36
38
40
42
44
46
48
50
52
54
56

FOOTREST GLIDE ASSEMBLY

BACKGROUND OF THE INVENTION

The present invention relates to medical examination tables and more particularly to a locking device for use with a footrest shelf which is slidable into and out of the examination table and a footrest pad which is slidable relative to the footrest shelf.

The medical profession commonly uses tables having an upper padded surface upon which a patient lies while being examined. Such examination tables may be provided with a footrest shelf which is slidable into and out of the table and which is provided with a separately movable footrest pad. The footrest pad may be slid back into the table, after the shelf has been extended out of the table, to expose a treatment pan located in an aperture formed in the shelf.

In order to ensure that the pad remains in position relative to the shelf, either when the patient's feet are resting on the pad or when the shelf is being moved into and out of the table, locking means in the form of feet made of a friction enhancing material, such as rubber, are mounted on the bottom of the pad. However, such locking means require that a certain amount of downward force be applied to the pad to effectively prevent it from sliding relative to the shelf.

Further, the free movement of the pad as it is moved back to uncover the treatment pan is inhibited by any contact between the rubber feet and the shelf. It is necessary to provide a certain amount of lifting force to the pad as it is moved in order to facilitate sliding the pad relative to the shelf.

Thus, there is a need for locking means for use in combination with a footrest pad and shelf which will positively lock the pad in a position covering the shelf such that a footrest for a patient is provided, and which will also allow the pad to be moved relative to the shelf with a minimum amount of effort in order to expose a treatment pan in the shelf.

SUMMARY OF THE INVENTION

The present invention is directed toward a locking assembly for use in combination with a footrest shelf and footrest pad which are movable relative to each other, and which are mounted in a medical examination table.

In a preferred embodiment of the invention, a footrest shelf is provided which is slidable into and out of an examination table. A footrest pad is provided which is movable along a planar upper surface of the shelf in a direction parallel to the movement of the shelf into and out of the table. A locking assembly is provided on the pad and the shelf to positively lock the pad in position adjacent an end of the shelf extended away from the table, and to further allow free movement of the pad when in an unlocked position.

Also, in the preferred embodiment, the shelf is provided with guide slots extending along either side of the upper shelf surface, each of the slots terminating in a hole at a forward end away from the table. The pad is provided with a pair of cylindrical glide members, each of the glide members having a follower portion and a locking portion. The follower portion being of a smaller diameter than the locking portion and being adapted to be received in the guide slot of the shelf, and the locking portion being adapted to be received in the hole.

A shoulder is formed between the follower and the locking portions. The shoulder rests on the planar surface of the shelf when the follower is engaged the shelf slot and facilitates the free sliding movement of the pad relative to the shelf.

When the glide member reaches the hole at the end of its travel within the slot, the locking portion enters the hole to positively locate the pad in position relative to the shelf. The pad may be released from the locking position by lifting the pad and moving it back to allow the shoulder to rest on the shelf.

The shelf is provided with an aperture in the planar surface for receiving a treatment pan, and the slots extend forward along either side of the aperture.

Thus, the present invention provides an efficient means for positively locking the footrest pad over the aperture and treatment pan on the shelf when it is at its forward most position, as well as means for facilitating the movement of the pad back into the table to expose the aperture and treatment pan for use.

Other objects and advantages of the invention will be apparent from the following description, the accompanying drawings, and the appended claims.

DETAILED DESCRIPTION OF THE PREFERRED EMBODIMENT

Figures 1, 2:
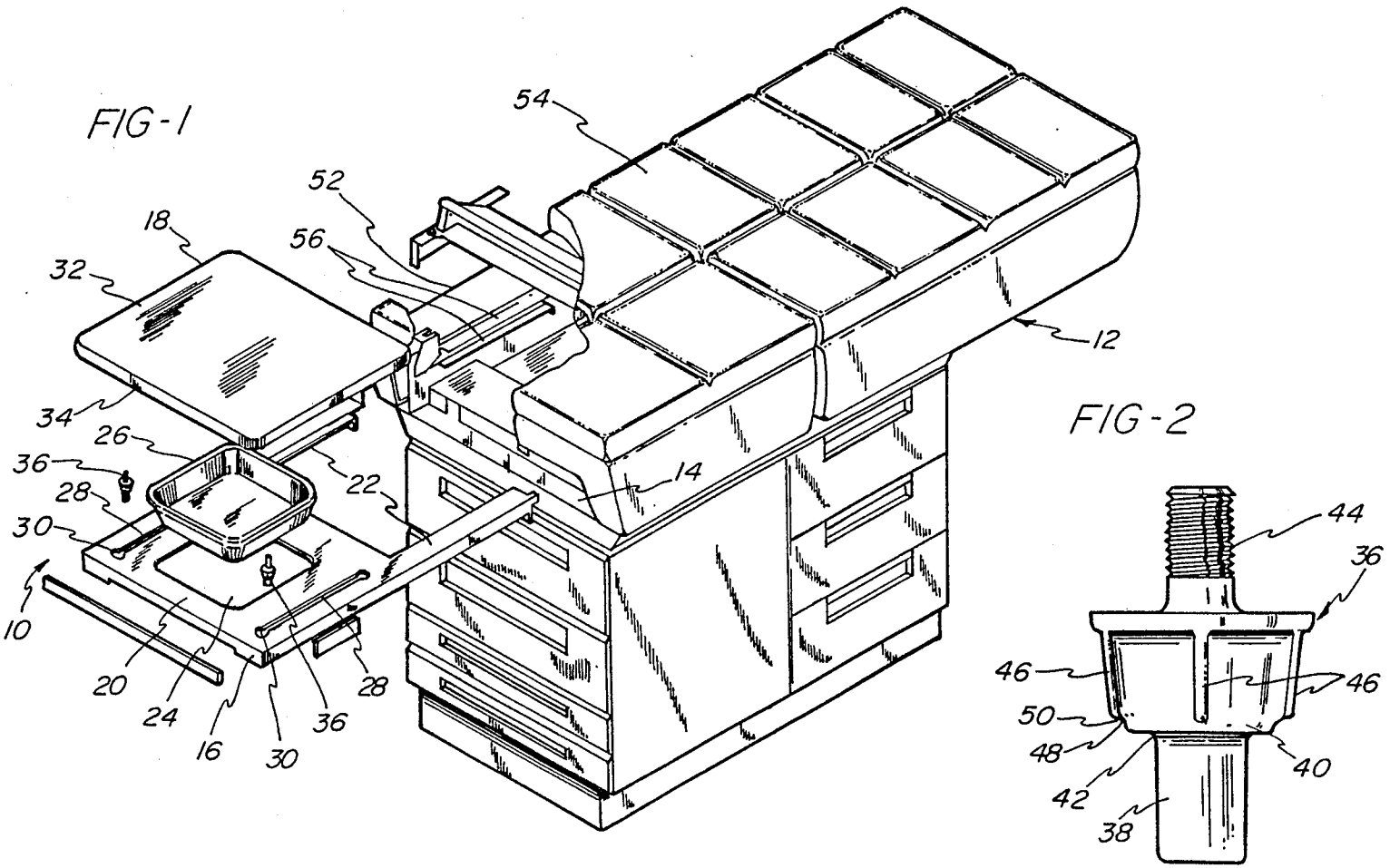
FIG. 1 is an exploded view of the shelf assembly of the present invention.
FIG. 2 is a side view showing the glide member of the locking assembly.

Referring to the drawings, the present invention is intended for use with a footrest assembly 10 of a medical examination table 12. The footrest assembly 10 being slidable into and out of an aperture 14 in the table.

The footrest assembly 10 includes a footrest shelf 16, and a footrest pad 18 which is movable relative to the shelf 16. The shelf 16 is substantially rectangular and comprises a forward upper planar surface 20 and two parallel longitudinally oriented arms 22 positioned along opposite sides of the shelf 16, and which extend rearwardly from the shelf 16.

As can be seen in FIG. 1, the shelf 16 also includes an aperture 24 in a central portion thereof for receiving a treatment pan 26. Slots 28 are located on either side of the aperture 24 and form a part of a footrest locking assembly to be described further below. The slots 28 are oriented longitudinally parallel to the arms 22 and each terminates in a hole 30 located at an end distal from the table 12 when the shelf assembly 10 is in an extended position. The holes 30 have a diameter which is greater than the width of the slots 28 and form an additional part of the locking assembly.

The footrest pad 18 includes an upper padded surface 32 and a lower surface 34 for engaging and resting upon the planar surface 20 of the shelf 16. The pad 18 is provided with two footrest glide members 36 which are attached to opposite sides of the lower surface 34 of the pad 18 at a forward portion of the pad 18. The glide members 36 are spaced apart a distance equal to the spacing between the slots 28 in the planar surface 20 of the shelf 16, and form a part of the locking assembly cooperating with the slots 28.

As can be seen in FIG. 2, the glide members 36 are formed in the shape of cylindrical members having a lower follower portion 38 and an upper locking portion 40. The follower portion 38 is formed with a smaller diameter than the locking portion 40 such that a shoulder 42 is formed between the two portions. A threaded shank 44 is located on the end of the locking portion 40 opposite from the follower portion 38 for being threadably attached into threaded sockets (not shown) formed in the lower surface 34 of the pad 18.

The glide member 36 further includes a plurality of ribs 46 located on the locking portion 40. The ribs 46 are oriented parallel to the longitudinal axis of the glide member 36 and extend from a point adjacent to the threaded shank 44 to a point 48 adjacent to and spaced from the shoulder 42. The ends of the ribs 46 adjacent to the shoulder 42 form substantially radially extending edges 50.

The follower portion 38 of the glide member 36 is formed with a diameter which is less than the width of the shelf slot 28 and is adapted to be received within the slot 28. When the follower portion 38 is positioned within the slot 28, the shoulder 42 rests upon the planar surface 20 of the shelf 16 such that the pad 18 is supported for movement back and forth along the shelf 16. The glide member 36 is preferably formed of a low friction material such as nylon, or a nylon plastic resin material such as is made by Cookson America, Inc. under the trademark "TEXALON" 1200A or the like, to facilitate the free movement of the pad 18 relative to the shelf 16.

The locking portion 40 of the glide member 36 is formed with a diameter which is less than the diameter of the hole 30 and is adapted to be received within the hole 30. When the locking portion 40 is received within the hole 36, the radially extending edges 50 of the ribs 46 rest upon the planar surface 20 of the shelf and the pad 18 is positively locked in position relative to the shelf 16.

The examination table 12 is of conventional design and is provided with an elongated frame 52 for mounting a patient supporting surface 54 thereon with the aperture 14 at one end for receiving the footrest assembly 10. The table frame 52 is provided with a pair of guide rails 56 located on either side of the aperture 14 for guiding movement of the footrest assembly 10, such that an arm 22 of the footrest assembly 10 is received between each pair of guide rails 56.

Figure 3:
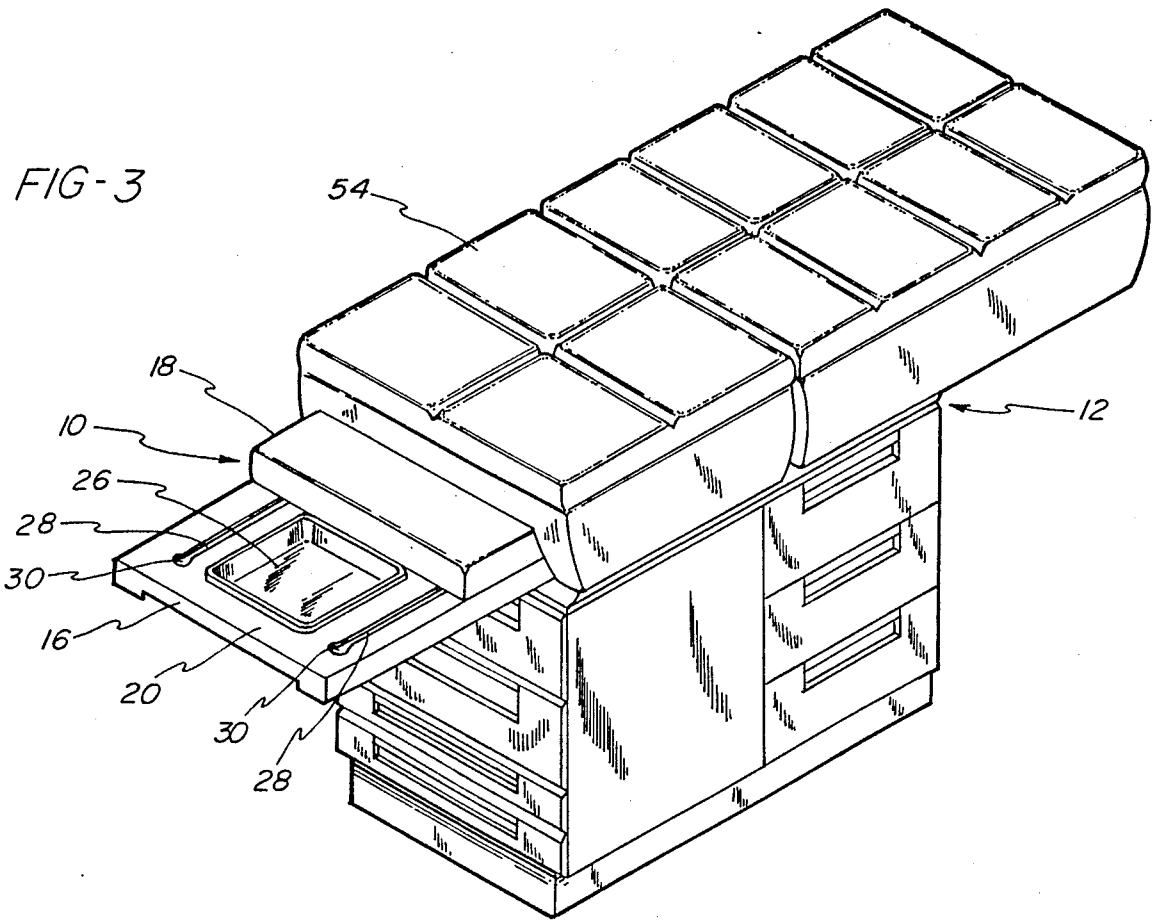
FIG. 3 is a perspective view showing the pad slid back into the table to expose the treatment pan.
Figure 4:
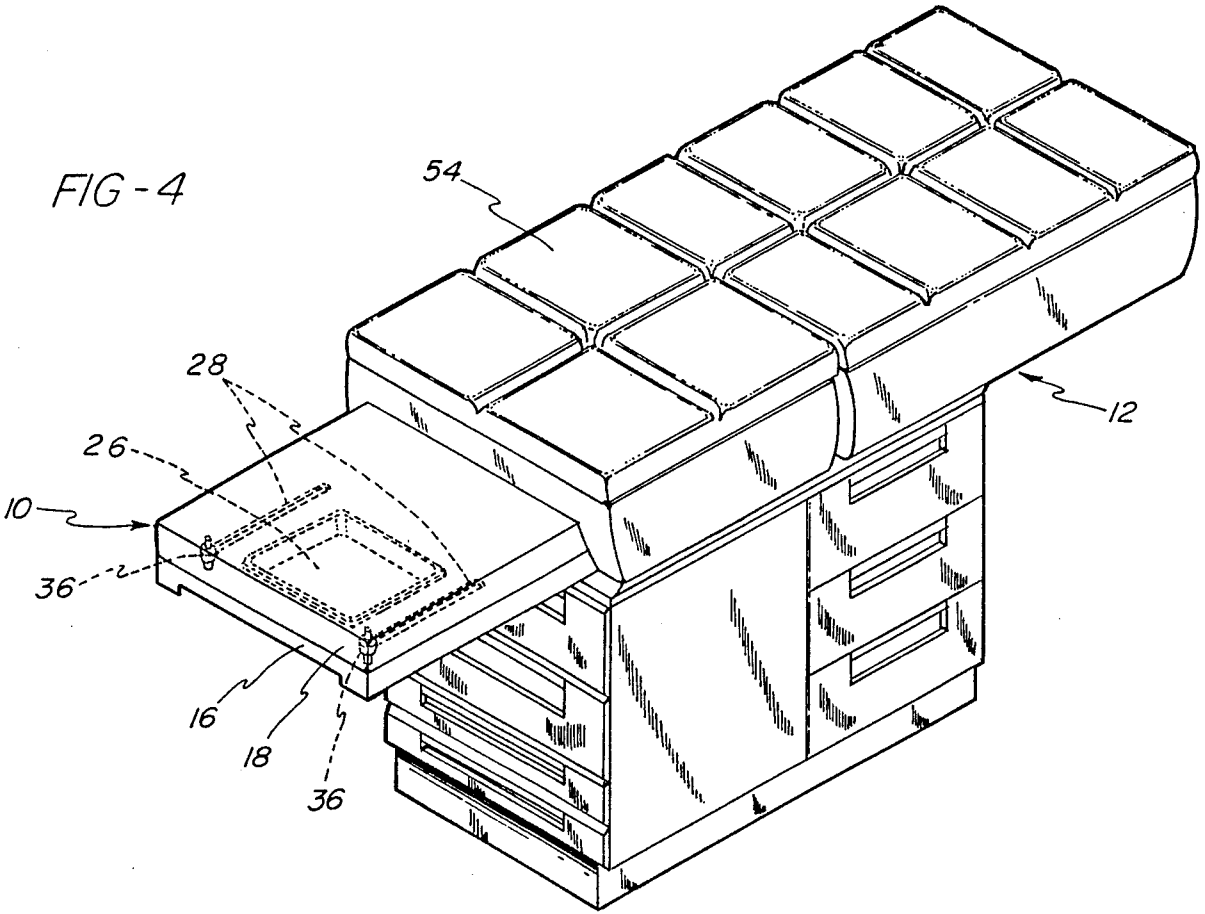
FIG. 4 is a perspective view showing the pad and the shelf of the shelf assembly in the locked position.

As is apparent from the above description, the shelf assembly 10, with the locking portion 40 of the glide member 36 engaged in the hole 30 of the shelf 16, may be slid out from within the table 12 to expose the padded portion 32 of the assembly for use as a footrest, as shown in FIG. 4. When desired, the front portion of the pad 18 carrying the glide members 36 may be lifted slightly to remove the locking portions 40 of the glide members 36 from the holes 30, and the pad 18 may be moved back into the table 12 to expose the treatment pan 26 for use, as shown in FIG. 3. The movement of the pad 18 is facilitated by the low friction contact formed between the glide member shoulder 42 and the planar surface 20 of the shelf 16.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. An examination table footrest locking assembly for use in combination with a footrest pad having an upper and lower surface and a footrest shelf having a planar upper surface and at least two parallel sides, said shelf planar surface supporting said pad for sliding movement of said pad relative to said shelf in a direction parallel to said parallel sides, said locking assembly comprising glide means on said lower pad surface, and guide and locking portions on said shelf, said glide means having a follower and a locking portion, said shelf guide portion receiving said glide means follower for guiding the sliding movement of said pad relative to said shelf, said shelf locking portion receiving said glide means locking portion to prevent sliding movement of said pad relative to said shelf.

2. The locking assembly of claim 1 wherein said shelf guide and locking portions comprise means defining a slot and means defining a hole, respectively, formed in said upper surface of said shelf, said slot extending parallel to said parallel sides.

3. The locking assembly of claim 2 wherein said glide means follower comprises an elongated portion dimensioned to fit within said slot, said glide means locking portion being dimensioned to fit within said hole and wherein the diameter of said hole is greater than the width of said slot.

4. The locking assembly of claim 3 wherein said glide means is formed as a cylindrical member and said glide means follower is a smaller diameter than said glide means locking portion.

5. The locking assembly of claim 4 wherein a shoulder is defined between said glide means follower and locking portions, and wherein longitudinally extending ribs are defined along said glide means locking portion, said ribs extending from an end of said glide means distal from said shoulder to a point adjacent to and longitudinally spaced from said shoulder, such that said shoulder rests upon said shelf planar surface when said follower is located in said slot, and said ribs rest upon said shelf planar surface when said glide means locking portion is located in said hole.

6. The locking assembly of claim 5 wherein said glide means is made of a low friction material to facilitate sliding movement of said pad relative to said shelf.

7. The locking assembly of claim 6 wherein said glide means is made of a nylon material.

8. The locking assembly of claim 5 wherein said shelf is provided with guide arms extending along said parallel shelf sides for guiding movement of said shelf and pad into and out of an examination table.

9. The locking assembly of claim 8 wherein said shelf is provided with means defining an aperture for receiving a treatment pan, and said pad may be slid to a position exposing said aperture and locked in a position covering said aperture.

10. A footrest locking assembly for use with an examination table having a footrest shelf slidable into and out of said examination table and a footrest pad which is slidable relative to said footrest shelf, said footrest shelf comprising a forward planar surface and two parallel longitudinally oriented arms positioned on opposite sides of and extending rearwardly from said planar surface, said planar surface having means along opposite sides of said aperture, said shelf further having means defining a hole at a forward end of each of said slots, said holes having a diameter greater than the width of said slots, said footrest pad comprising an upper padded surface and a lower surface for engaging and resting upon said shelf, footrest glide members attached to opposite sides of a forward portion of said pad lower surface, said glide members being spaced a distance equal to the spacing between said slots in said planar surface of said shelf, said glide members being made of a low friction material and formed as cylindrical members having a lower follower portion and an upper locking portion, said follower portion having a smaller diameter than said locking portion such that a shoulder is formed between said portions, a threaded shank is provided at an end of said glide member opposite from said follower portion for attaching said glide member to said lower surface of said pad, a plurality of ribs extend longitudinally along said locking portion from said threaded shank to a point spaced from said shoulder, the ends of said ribs opposite from said shank forming substantially radially extending edges, said follower portion being of a lesser diameter than and adapted to be received within said slot width such that when said follower portion is positioned within said slot, said shoulder rests upon said planar surface of said shelf, said locking portion being of lesser diameter than and adapted to be received within said hole such that when said locking portion is positioned within said hole, said axially extending edges of said ribs rest upon said planar surface, said glide member cooperating with said shelf to lock said pad in position relative to said shelf when said locking portion is located in said hole such that said pad may be locked in position over said aperture in said shelf as said shelf is moved into and out of said examination table, said pad being slidable longitudinally relative to said shelf when said locking portion is lifted out of said hole and said pad is pushed rearwardly to rest said glide member shoulder on said planar surface and engage said follower portion in said slot such that said pad may be moved rearwardly to expose said treatment pan when said shelf is extended from said table.

* * * * *